United States Patent [19]

Perham et al.

[11] Patent Number: 4,998,479

[45] Date of Patent: Mar. 12, 1991

[54] SMOKE GENERATING DEVICE WITH RECHARGABLE CARTRIDGE

[76] Inventors: William J. Perham, 1603 Morganton Rd., Fayetteville, N.C. 28305; Daniel Watlington, Rte. 10, Box 114, Fayetteville, N.C. 28301

[21] Appl. No.: 206,883

[22] Filed: Jun. 15, 1988

[51] Int. Cl.[5] ..... C06D 3/00; F42B 13/44; A01M 13/00; C09K 3/30

[52] U.S. Cl. ..... 102/334; 43/127; 102/329; 102/370; 239/133; 239/136; 252/305

[58] Field of Search ..... 86/20, 11; 252/305; 102/327, 328, 329, 334, 502; 219/272, 275, 300, 304; 239/133, 136; 43/127, 129, 900

[56] References Cited

U.S. PATENT DOCUMENTS

| | | | |
|---|---|---|---|
| H360 | 11/1987 | Shukis et al. | 102/334 |
| 2,686,160 | 8/1954 | Kell et al. | 252/359 |
| 3,214,860 | 11/1965 | Johnson | 43/129 |
| 3,623,260 | 11/1971 | Konle | 43/129 |
| 3,986,670 | 10/1976 | Syveson | 43/129 |
| 4,326,119 | 4/1982 | Swiatosz | 43/129 |
| 4,349,239 | 9/1982 | Swiatosz | 219/271 |
| 4,439,341 | 3/1984 | Swiatosz | 252/305 |
| 4,636,364 | 1/1987 | Geyer et al. | 422/162 |
| 4,667,601 | 5/1987 | Diamond et al. | 102/368 |
| 4,724,018 | 2/1988 | Espagnacq et al. | 149/87 |
| 4,727,811 | 3/1988 | Lubbërs | 102/334 |
| 4,732,085 | 3/1988 | Gershenson et al. | 102/334 |

*Primary Examiner*—Howard J. Locker

*Attorney, Agent, or Firm*—Rhodes, Coats and Bennett

[57] ABSTRACT

A smoke generating device is disclosed which utilizes a rechargable cartridge containing a vaporizable, smoke producing solution. The cartridge includes an aperture which is filled by a one-way, flap-type seal. When mounting the cartridge to the smoke generating device, a feed tube is inserted through the flap-type seal into the cartridge. In this manner, the contents of the cartridge are supplied to a valve means within the smoke generating device. When the valve means is actuated, the smoke producing fluid flows through a vaporizer coil. Heat supplied by a gas burner or other heating device vaporizes the smoke producing solution which issues as a dense simulated smoke from a smoke discharge nozzle. In a preferred embodiment of the invention, a flow restricting means is provided in the vaporizer coil to maintain the rate of flow of smoke producing liquid within a predetermined range.

10 Claims, 1 Drawing Sheet

SMOKE GENERATING DEVICE WITH RECHARGABLE CARTRIDGE

FIELD OF THE INVENTION

The present invention relates generally to training devices for firefighters, policemen and military personnel, and more particularly to a training device for producing a simulated smoke.

BACKGROUND OF THE INVENTION

In the past, numerous devices have been used for producing a simulated smoke. One such device discussed in U.S. Pat. No. 4,326,119 simulates smoke by heating a vaporizable, smoke producing liquid within a tubular coil to a predetermined temperature so as to completely vaporize the liquid. A direct current voltage source supplies the current for heating the tubular coil. Once the liquid is heated, it is released into the atmosphere as a vapor by a smoke discharge cap. Although intended to be reused, a number of components such as a heat fusible release disk and heat fusible actuator rod must be replaced. The task of maintaining an adequate supply of these components is one of the primary disadvantages of this device.

Insect foggers, although intended for an entirely different purpose, have the inherent ability to generate a toxic smoke for killing insects. For instance, in U.S. Pat. No. 3,986,670, there is disclosed an insect fogger which utilizes an aerosol container containing an insecticide solution. A plunger actuates the valve means on the aerosol container so that the contents are supplied to a coiled conduit. The insecticide solution is heated as it passes through the coiled conduit to the discharge outlet where it issues as a toxic fog. When the contents of the container are expended, the container is disposed of and replaced with a new, charged container.

Although avoiding the problem of replacing components, the insect fogger creates new equally perplexing problems. There is mounting scientific evidence tending to prove that the aerosols used to expell the contents of the container are a significant factor contributing to the depletion of the ozone layer of the earth's atmosphere. Thus, there is a need for a safer method of producing a simulated smoke without need for replacement of essential components.

SUMMARY AND OBJECTS OF THE INVENTION

The present invention avoids the aforementioned problems with the prior art by utilizing a rechargable cartridge wherein the contents are pressurized by the factory or by the user prior to attachment to the smoke generating apparatus. In a preferred embodiment of the invention, the rechargable cartridge includes an aperture in the top portion thereof including a one-way seal to prevent discharge of the pressurized contents. The feed tube extending from the housing of the smoke generating device is adapted to be inserted through the one-way seal on the cartridge when the cartridge is being attached to the housing. In this manner, the contents of the cartridge are supplied to a valve means within the housing of the smoke generating device. When the valve means is actuated, the smoke producing liquid flows through the vaporizer coil where it is heated. The vaporized solution is then discharged through a smoke discharge port as a dense smoke.

Accordingly, it is the primary object of the present invention to provide a device for producing a simulated smoke for training firemen, policemen, and military personnel.

Another object of the present invention is to provide a smoke generating device which can be reutilized without having to replace essential components.

Another object of the present invention is to provide a smoke generating device which utilizes disposable cartridges which can be charged either by the manufacturer or user prior to attachment to the smoke generating device.

Another object of the present invention is to provide a smoke generating apparatus which utilizes a non-aerosol container wherein the contents are expelled without chemical assistant which are potentially harmful to the ozone layers of the atmosphere.

Another object of the present invention is to provide a smoke generating device which is relatively simple in construction thus minimizing the risk of mechanical failure.

DETAILED DESCRIPTION OF THE INVENTION

Figures 1, 2, 3:
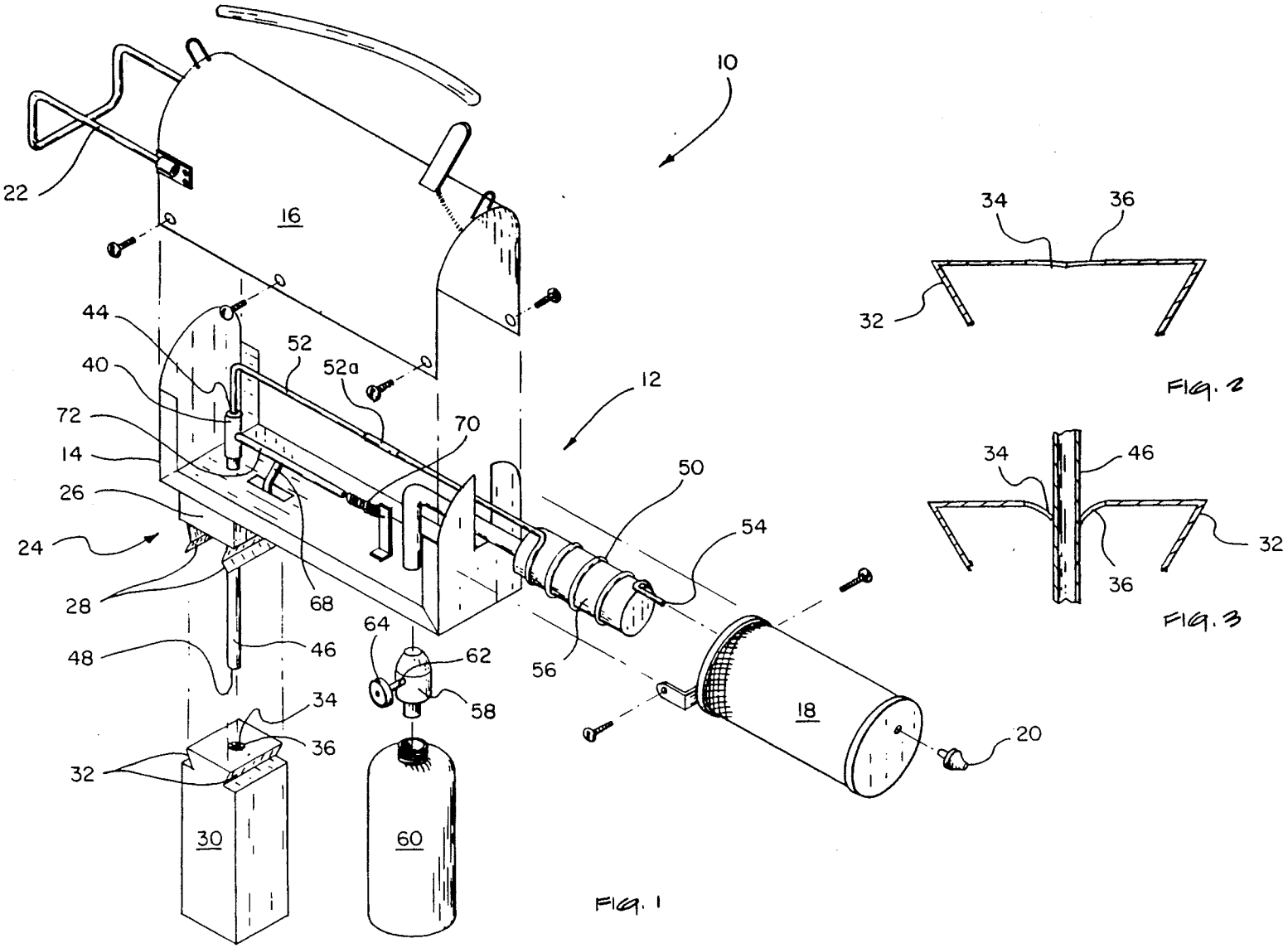
FIG. 1 is an exploded perspective of the smoke generating device of the present invention.
FIG. 2 is a partial section showing the rechargable cannister used in connection therewith.
FIG. 3 is a partial section showing the rechargable cannister with the feed tube inserted through the one-way seal.

Referring now to FIG. 1, the smoke generating device of the present invention is shown therein and referred to generally by the numeral 10. Smoke generating device 10 includes a housing indicated generally at 12 which includes a frame 14 enclosed by a shell 16. A heat shield or manifold 18 forms a part of housing 12 and extends from the forward end of the frame 14. A smoke discharge nozzle 20 is secured at the forward end of the heat shield 18.

Extending rearwardly from frame 14 is an optional wire bracket 22 for spacing the smoke generating device 10 from the user's body. On the underside of frame 14, there is a boss 24 formed with a cartridge receptacle 26 including a resilient spring-type clip 28. The cartridge receptacle 26 is adapted to receive the upper end of a rechargable cartridge 30 having gripping elements 32 on the upper end thereof which are engaged by the spring-type clips 28. The rechargable cartridge 30 is formed with an aperture 34 at its upper end which is sealed by a one-way flap type seal 36. The cartridge 30 is adapted to contain a vaporizable smoke producing liquid (not shown) under pressure. When pressurized, the internal pressure of the cartridge 30 exerts a force against the flap-type seal 36 causing the flaps to move to a closed position.

Within housing 12, there is mounted a conventional valve 40 including an intake 42 and discharge outlet 44. A trigger 68 is pivotally mounted to the housing 12 and is biased to an inoperative position by a spring 70. A linkage 72 is pivotally connected at one end to the trigger 68 and at its opposite ends to the valve 40. The trigger 68 is movable from its normal inoperative position to an operative position by application of finger pressure to actuate valve 40 as hereinafter described.

A feed tube 46 is connected at one end to the intake 42 and extends downwardly through the cartridge receptacle 26. The feed tube 46 is adapted to be insert through the flap-type seal 36 in cartridge 30 when in the process of attaching the cartridge 30 to the housing 12. When the cartridge 30 is fully inserted and the clip 28 engages the gripping elements 32, the inlet 48 of the feed tube 46 is disposed in the lowermost regions of the cartridge 30. The internal pressure of the cartridge 30 presses the individual flaps of the seal 36 against the surface of the feed tube 46 thus sealing the cartridge 30 even with the feed tube 42 inserted. A vaporizer coil 50 is disposed within heat shield 18. Vaporizer coil 50 includes an inlet portion 52 connected to the discharge outlet 44 of valve 40, and a discharge portion 54 connected to the smoke discharge nozzle 20. The vaporizer coil 50 is adapted to heat the smoke producing liquid (not shown) therein so as to vaporize the liquid and thus produce simulated smoke which issues from the smoke discharge nozzle 20. In the preferred embodiment, a restriction **52*a* is formed in the inlet portion of the coil 50, to slow the flow of smoke producing liquid through the coil 50** assuring sufficient time to vaporize the solution.

To supply the heat needed to vaporize the liquid, there is a gas burner 56 disposed within the vaporizer coil 50. A standard liquid propane valve 58 adapted to receive and activate a liquid propane gas cartridge is mounted to the housing 12. The valve 58 is a standard design which threadably engages the neck of a standard gas cartridge 60. Valve 58 includes an actuating rod or plunger 62 to open the valve of the gas cartridge. A control knob 64 is provided to move the actuating rod 62 into an operative position and to start the flow of gas from the cartridge 60 through the valve 58. The gas then flows through the fuel line 66 to the gas burner 56 where it is burned to produce heat.

In operation, a charged cartridge 30 is attached to housing 12 as previously described. Once attached, the smoke producing liquid is supplied via feed tube 46 to the valve 40. The gas cartridge is also threaded onto valve 58. The control knob 64 is turned to start the flow of gas to burner 56 which is then lit by inserting a match through one of the openings in the heat shield 18. Sufficient time should be allowed to preheat the vaporizer coil 50. Once the vaporizer coil 50 is heated, trigger 68 is depressed by the forefinger on one hand to move it from its inoperative position to an operative position. The depression of trigger 68 actuates valve 40 so that smoke producing liquid 38 flows through valve 40 to the vaporizer coil 50. Once inside the vaporizer coil 50, the smoke producing liquid is vaporized by the heat from gas burner 56 and is discharged as a dense smoke through the smoke discharge nozzle 20. When trigger 68 is released, spring 70 will automatically return trigger 68 to its inoperative position thereby closing valve 40 and interrupting the flow of smoke producing liquid to the vaporizer coil 50.

One of the primary advantages of the present invention is that the contents of the rechargable cartridge 30 are pre-pressurized so that the need for a hand pump to pressurize the contents is eliminated. Another advantage of the invention is that cartridges 30 can be recharged either by returning the cartridges to the manufacturer or by providing the user with a separate pumping unit (not shown) adapted to refill and pressurize the cartridges 30.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A smoke generating apparatus comprising: a housing; a rechargable cartridge containing a vaporizable, smoke producing solution under pressure, said cartridge including a discharge opening and a one-way flap type seal which is urged to a closed position by the pressurized contents of the cartridge; means for securing said cartridge to said housing; valve means mounted in said housing and having an intake and a discharge outlet; a feed tube connected at one end to the intake of said valve means and extending from said housing, the feed tube being adapted for insertion through the one-way seal in the cartridge when the cartridge is attached to the housing; a vaporizor coil mounted in the housing and including an inlet end connected to the discharge outlet of the valve means and a discharge end, the vaporizer coil being adapted to vaporize the smoke producing liquid therein; a smoke discharge nozzle connected to the discharge end of the vaporizer coil for discharging the vaporized solution from the vaporizer coil; means for heating the smoke producing liquid as the same flows through the vaporizer coil to vaporize the smoke producing liquid; and means for actuating the valve means to introduce the contents of the rechargable cartridge into the vaporizer coil.

2. The smoke generating apparatus according to claim 1 wherein the actuating means comprises a trigger operatively connected to said valve, said trigger being movable from a normal inoperative position to an operative position by application of finger pressure.

3. The smoke generating apparatus according to claim 2 further including means to bias the trigger to an inoperative position.

4. The smoke generating apparatus according to claim 1 further including flow restricting means for maintaining a relatively constant flow of smoke producing solution through the vaporizer coil.

5. The smoke generating apparatus according to claim 1 wherein said heating means comprises a valve means mounted to said housing adapted to receive and activate a standard gas cartridge, a gas burner disposed within the vaporizer coil, and a fuel line connecting the valve means and the gas burner.

6. A smoke generating apparatus comprising: a housing; a rechargable cartridge mounted to said housing and containing a vaporizable, smoke producing liquid under pressure; a valve means mounted in the housing including an intake operatively connected to the cartridge and a discharge outlet; a vaporizable coil having an inlet end operatively connected to the discharge outlet of the valve means and a discharge end, said vaporizer coil being adapted to vaporize the smoke producing liquid therein; a smoke discharge nozzle connected to the discharge end of the vaporizer coil for discharging the vaporized liquid; means for heating the vaporizer coil as the smoke producing liquid flows therethrough to vaporize the smoke producing liquid; means for actuating the valve means to introduce the contents of the cartridge into the vaporizer coil; and flow restricting means for maintaining a relatively constant rate of flow of smoke producing solution through the vaporizer coil.

7. The smoke generating apparatus according to claim 6 wherein the actuating means comprises a trigger operatively connected to the valve means, the trigger being movable from a normal inoperative position to an operative position by application of finger pressure.

8. The smoke generating apparatus according to claim 7 further including means to bias the trigger to an inoperative position.

9. A method for producing smoke comprising: filling a rechargable cartridge having a one-way seal with a vaporizable, smoke producing solution; pressurizing the contents of the cartridge; coupling the cartridge to a smoke generating device including a feed tube operatively connected to the intake of a valve means, a vaporizer coil having an inlet operatively connected to the discharge outlet of the valve means and a discharge end operatively connected to a smoke discharge nozzle, the step of coupling the cartridge to the smoke generating device including inserting the feed tube through the seal in the cartridge so that the contents of the cartridge are supplied to the valve means; actuating the valve means to direct the flow of smoke producing solution through the vaporizer coil; heating the vaporizer coil as the smoke producing solution flows therethrough to vaporize the solution; and discharging the vaporized solution through a smoke discharge nozzle operatively connected to the vaporizer coil.

10. The method according to claim 9 further including the step of restricting the flow of smoke producing solution through the vaporizer coil to maintain the flow rate within a predetermined range.

* * * * *